US005133260A

United States Patent [19]

Grosch

[11] Patent Number: 5,133,260

[45] Date of Patent: Jul. 28, 1992

[54] MINE EQUIPPED WITH A POSITIONING DEVICE

[75] Inventor: Hermann Grosch, Wülfrath, Fed. Rep. of Germany

[73] Assignee: Rheinmetall, Dusseldorf, Fed. Rep. of Germany

[21] Appl. No.: 726,972

[22] Filed: Jul. 8, 1991

[30] Foreign Application Priority Data

Jul. 7, 1990 [DE] Fed. Rep. of Germany ..... 4021685

[51] Int. Cl.[5] ..... F42B 23/00; F42B 23/24

[52] U.S. Cl. ..... 102/401; 102/425

[58] Field of Search ..... 102/401, 425, 424; 89/1.14

[56] References Cited

U.S. PATENT DOCUMENTS

| | | | |
|---|---|---|---|
| 4,922,824 | 5/1990 | Schubart | 102/425 |
| 4,934,271 | 6/1990 | Kensok et al. | 102/401 |
| 4,934,274 | 6/1990 | Mathey | 102/401 |
| 4,969,398 | 11/1990 | Lundwall | 102/425 |
| 4,979,444 | 12/1990 | Schoffl | 102/401 |

FOREIGN PATENT DOCUMENTS

| | | | |
|---|---|---|---|
| 0296382 | 12/1988 | European Pat. Off. . | |
| 2559179 | 7/1977 | Fed. Rep. of Germany | 102/401 |
| 3127071 | 1/1983 | Fed. Rep. of Germany | 102/401 |
| 1381702 | 1/1975 | United Kingdom . | |
| 2029941 | 3/1980 | United Kingdom . | |
| 2219651 | 12/1989 | United Kingdom . | |

*Primary Examiner*—David H. Brown

*Attorney, Agent, or Firm*—Spencer, Frank & Schneider

[57] ABSTRACT

An arrangement for positioning a mine includes a mine housing and an inflatable, balloon mounted on a lateral exterior side of the mine housing. A gas generator is disposed in the mine housing and connected to the balloon for providing a supply of gas for inflating the balloon. A position sensor is disposed in the mine housing for monitoring the upright position of the mine housing and connected to the gas generator for controlling the supply of gas to the balloon in dependence of the upright position of the mine. A plurality of fixing nails are mounted in the bottom of the mine housing for fixing the position of the mine housing on the ground.

8 Claims, 3 Drawing Sheets

MINE EQUIPPED WITH A POSITIONING DEVICE

BACKGROUND OF THE INVENTION

The present invention relates to an arrangement for fixing the position of a mine wherein the mine has a mine housing which includes a position sensor and a gas generator connected to an inflatable balloon attached to the outside of the housing.

Mines of this type, particularly the so-called intelligent mines, are increasingly brought into a target area by being launched from the ground or from the air. Customarily, various carrier systems, for example rockets, artillery projectiles or the like, are employed for this purpose.

After ejection from the carrier system, the mine generally drops to the ground in a decelerated manner so that the mine will not sink into the ground even if the ground is soft. Once it has landed on the ground, the mine should automatically take on an upright position, independently of the consistency of the terrain, and it should remain in this position during its deployment regardless of the weather.

German Patent No. 3,509,282 discloses a mine of this type which is equipped with an alignment device. If a target detecting sensor finds a target, this mine is oriented toward the target so that it is able to successfully combat the target, with the respective position of the mine being detected and evaluated by sensors. In one embodiment of this mine, balloons are provided to give it the orientation toward the target. These balloons are inflated by a pyrotechnic gas generator. They serve the particular purpose of tilting the mine into its orientation toward the target from a vertical lurking position so that it is able to effectively combat the target.

The drawback of the mine disclosed to German Patent No. 3,509,282 is that, for its alignment device (balloons) to function properly, the condition must be met that, after landing, the mine must come to sit on its underside. Experience has shown that this condition is met only rarely during the laying process. Since, moreover, this mine does not have the ability to permanently fix itself in its position relative to the ground, it is also not possible to ensure that the mine, after landing, is not toppled from its possibly advantageous position due to extraneous circumstances, particularly the influences of weather.

SUMMARY OF THE INVENTION

It is therefore an object of the invention to reliably upright the position of a mine of the above type which has been dropped or brought to the ground by a flying carrier system, and which there come to lie in any possible position, and to fix the upright position durably for long periods of waiting independently of the consistency of the terrain and of the weather.

The above and other objects are accomplished according to the invention by the provision of an arrangement for fixing the position of a mine, including: a mine housing having a lateral exterior side; an inflatable, balloon mounted on the lateral exterior side of the mine housing; gas generating means disposed in the mine housing and connected to the balloon for providing a supply of gas for inflating the balloon; position sensing means disposed in the mine housing for monitoring the upright position of the mine housing and connected to said gas generating means for controlling the supply of gas to the balloon in dependence of the upright position of the mine housing; and a plurality of fixing nails mounted in the bottom of the mine housing for fixing the position of the mine housing on the ground.

A further feature of the invention is that the fixing nails are individually composed of telescoping nail members. This results in the additional advantage of a particularly space saving structure requiring relatively little space for the nails in the mine housing.

The invention will now be described and explained in greater detail with reference to the drawing figures.

DETAILED DESCRIPTION OF PREFERRED EMBODIMENTS

Figure 1:
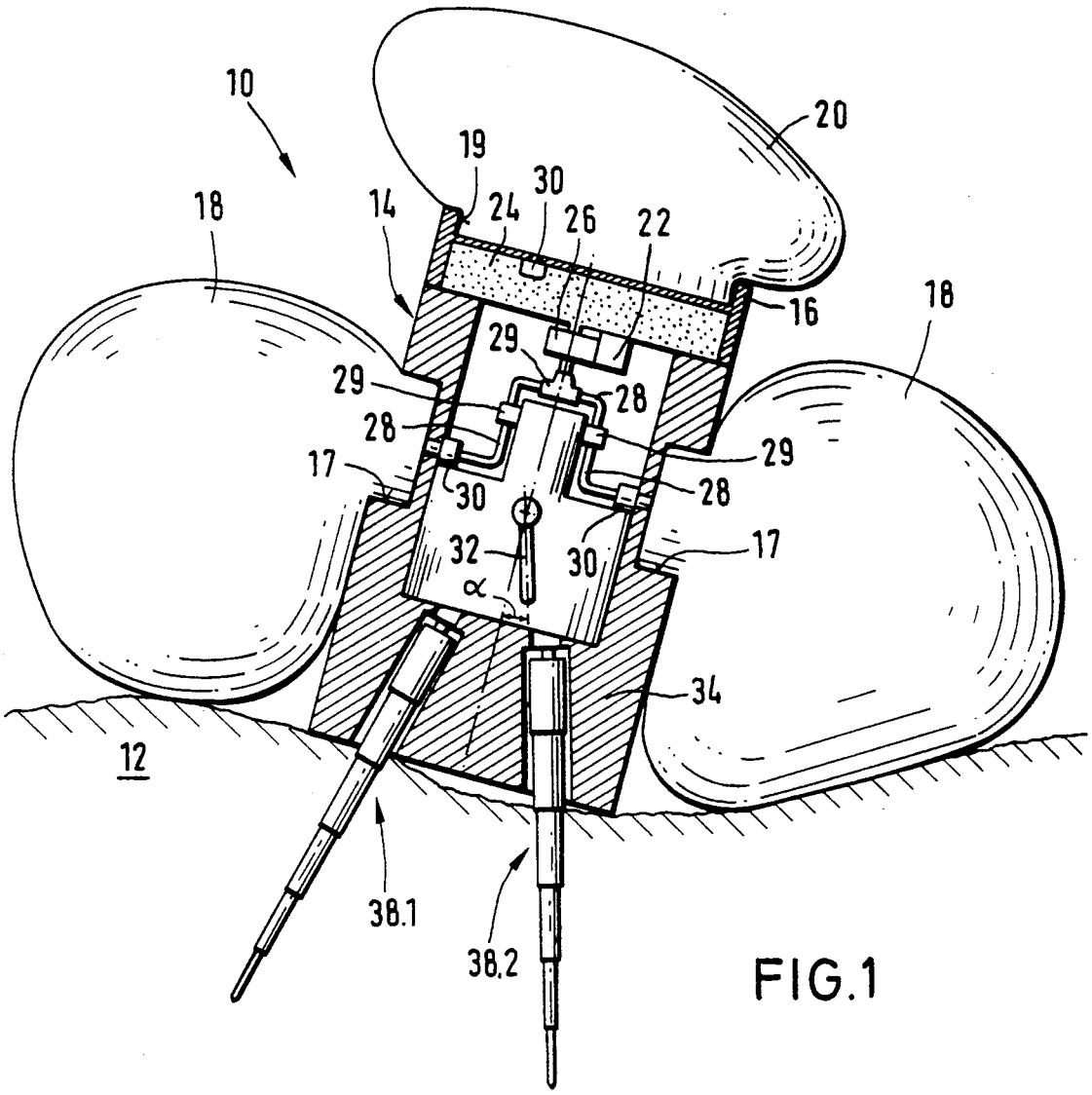
FIG. 1 shows a cross sectional side view of one embodiment of a mine according to the invention after it has been put into an upright position and has been fixed in this position.

FIG. 1 shows a mine 10 according to the present invention. After having been ejected from a carrier projectile or the like (not shown), the mine lies in the target area in a terrain, here marked as ground 12.

Mine 10 includes a mine housing 14 which at its top or head end is provided with a cover 16 and on its circumference (i.e. exterior lateral side) is provided with a continuous recess 17 in which tubular balloon 18 in the form of an annular hose is accommodated until the mine lands on ground 12. Without limiting the scope of the invention, however, a larger number of interconnected annular segmented balloons may also be provided.

Within cover 16, a head balloon 20 is provided in an upper recess 19. Head balloon 20 is filled a short time before the lateral balloon 18. A timer 22 accommodated in mine housing 14 is equipped with an integrated trigger and is started when mine 10 is dropped. In a known manner timer 22 can be set so that it actuates a pyrotechnic gas generator charge 24 only after the mine has landed and has settled down completely.

Gas generator 24 initially fills head balloon 20 through a nozzle 30 and then, after a time period set by a time delay member 26, for example after 5 seconds, it fills the hoselike lateral balloon 18. In this way it is ensured that mine 10, even if it lands on its head end, is flipped by way of the deployed head balloon 20 into a position relative to ground 12 which permits proper operation of lateral balloon 18.

In dependence on the position of mine 10 on ground 12, which is monitored by a sensor 32, preferably a verticality sensor in the form of a pendulum, accommodated in mine housing 14, gas generator 24 inflates balloon 18 to the extent necessary to put mine 10 into the desired upright position.

Gas generator 24, is preferably of the pyrotechnic type, which is already known, and is actuated in a known manner. Balloon 18 is connected to gas generator 24 by way of control flaps or valves 29 and gas conduits 28. At their ends, gas conduits 28 are equipped with nozzles 30 which open into balloon 18. If more balloons 18 of the type shown in FIG. 1 or more chambers are employed, it is clear that each balloon and each chamber must be fillable through its own gas conduit.

Mine 10 has a bottom 34 which accommodates fixing nails 38.1 and 38.2. Once mine 10 has been brought into the desired position under the control of verticality sensor 32, fixing nails 38.1, 38.2 which up to this moment have been accommodated in mine bottom 34 are driven out of mine bottom 34 into ground 12 in order to fix mine 10 in this desired position. In this way, mine 10 is durably fixed on ground 12 in an upright position.

Thereafter, switching of valves 29 releases the gas filling lateral balloon 18 so that it collapses. Preferably, balloon 18 as well as head balloon 20 are given such a coloration that, once collapsed, they enhance the camouflage of mine 10 on ground 12.

Figure 2:
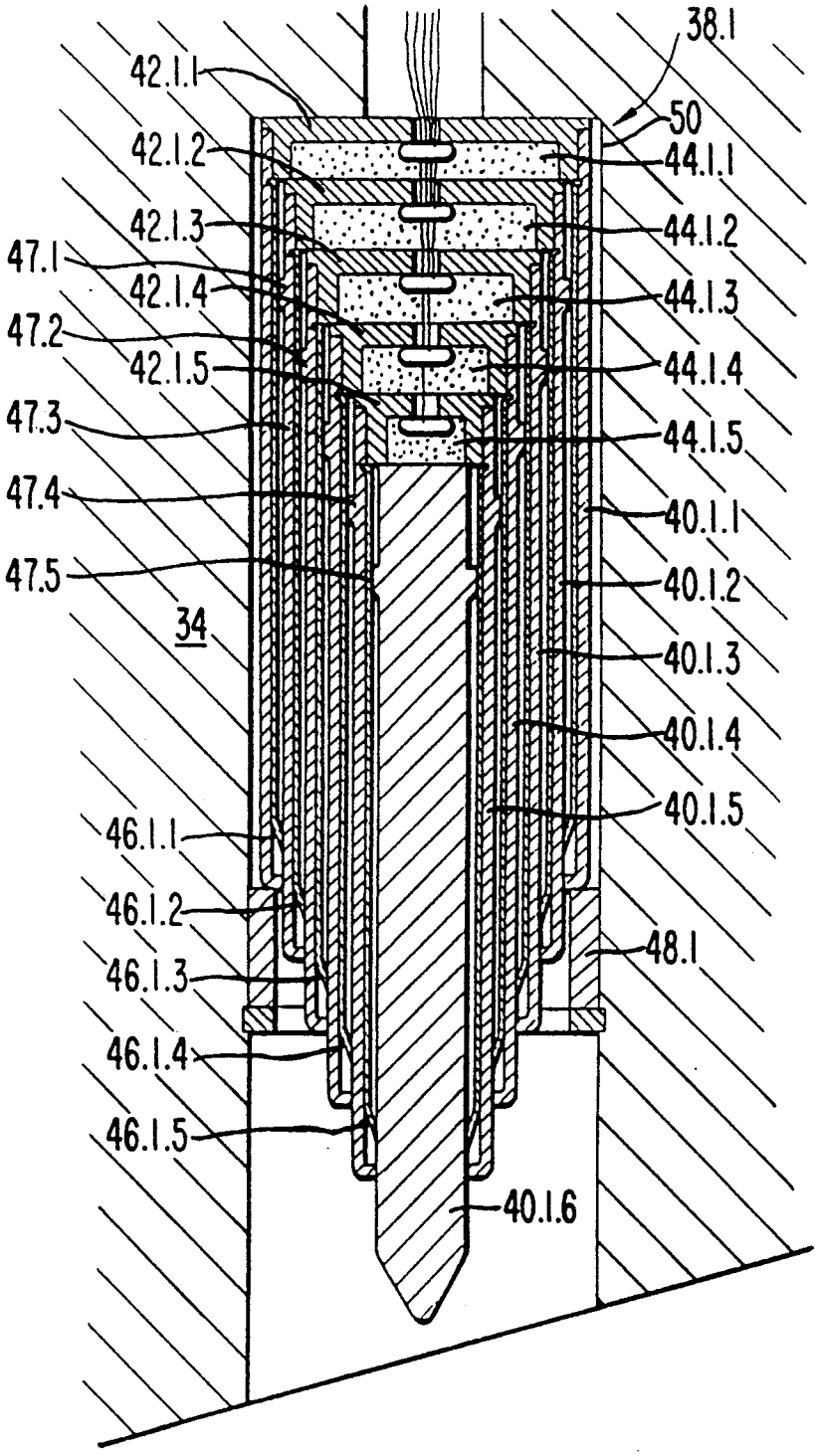
FIG. 2 is an enlarged illustration of an embodiment of a fixing nail according to the invention for the mine of FIG. 1.

As shown in the embodiment of FIG. 2, fixing nails 38.1, 38.2 preferably have a telescoping configuration. FIG. 2 shows, for the sake of clarification, only fixing nail 38.1, which is still disposed in a corresponding recess 50 in mine bottom 34 before it is shot into the ground.

In the embodiment of fixing nail 38.1 shown in FIG. 2, the nail is composed of telescoping nail members 40.1.1 to 40.1.6. Nail members 40.1.1 to 40.1.5 are each tubular and innermost nail member 40.1.6 is a solid body.

Upwardly, each nail member 40.1.1 to 40.1.5 is terminated by terminations 42.1.1 to 42.1.5, with each termination being cup-shaped and open toward the direction of extension of the fixing nail, i.e. toward the ground. Each termination 42.1.1 to 42.1.5 is provided with a pyrotechnic charge 44.1 to 44.5 that is oriented toward the adjacent lower termination, and in the case of pyrotechnic charge 44.1.5, oriented toward nail member 40.1.6. Pyrotechnic charges 44.1 to 44.5 are individually ignitable in succession beginning with pyrotechnic charge 44.1.5 and serve to eject the individual nail members, beginning with nail member 40.1.6.

To prevent sliding back of individual nail members 40.1.2 to 40.1.6 after they have been ejected, the nail members are provided with arresting devices 46.1.1 to 46.1.5. Arresting devices 46.1.1 to 46.1.5 are preferably leaf springs having downwardly bent tongues which are disposed in the respective annular spaces between nail members 40.1.1 to 40.1.6 and are fastened in the respective nail member terminations 42.1.1 to 42.1.5. After extension of the individual nail members 40.1.2 to 40.1.6, the bent tongues of arresting devices 46.1.1 to 46.1.5 engage in corresponding exterior beads 47.1.1 to 47.1.5 provided on the exterior circumference of nail members 40.1.2 to 40.1.6, and thus prevent the individual telescoped nail members 40.1.2 to 40.1.6 from sliding back.

A known fastening sleeve 48.1 serves to hold the interengaged telescoping nail members 40.1.1 to 40.1.6 in mine bottom 34. The statements made in connection with fixing nail 38.1 of FIG. 2 apply correspondingly for the second fixing nail 38.2 shown in FIG. 1 and, if provided, for all other fixing nails.

The advantage of the telescoping fixing nails 38.1, 38.2 provided in the described preferred embodiment is that when not extended, they take up very little space, and when extended, a counter-pulse acting on mine 10 is reduced considerably.

In practical experiments, the effectiveness of the mine positioning device according to the present invention has already been confirmed, with the device additionally meeting all demands placed on it.

In those practical tests the applicant used a 2-axis electrolytic tilt sensor for position sensor 32, e.g. a tilt sensor of type 'SP5000' of Spectron Inc, Hauppauge, N.Y. For time delay member 26 and timer 22 a general purpose circuit board was used wherein a desirable number of timer and time delay devices could be provided by well-known resistor-capacitor (R-C)-coupling to control thyristor-triodes, relay switches or to drive electrical bridge fuze initiators for set up of explosive charges 24. Those circuit boards are manufactered by the applicant and could be delivered as custom-made boards.

Figure 3:
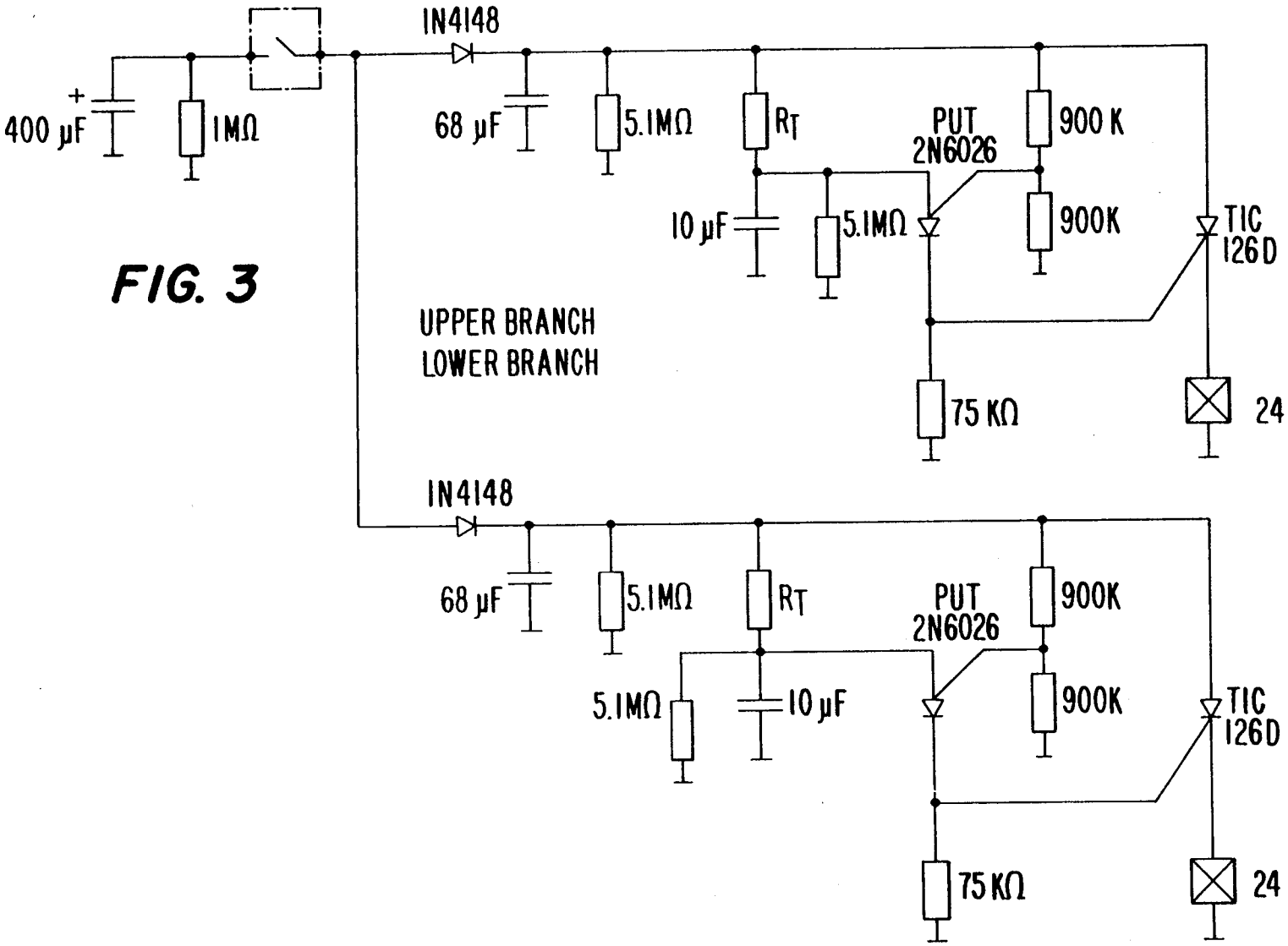
FIG. 3 showes an embodiment of an electronic circuit for timer/time delay devices to control explosive charges and/or switching valves according to the invention.

An example of an electronic circuit is shown in FIG. 3. The operation principles could be described as follows: After closing a general security switch (not numbered), after launch of the mine, electrical supply power from a battery, capacitor storage source or thatlike is given to at least one timer/time delay branch behind the switch. Depending on the values of the $R_T$-C-member, a certain threshold voltage level is reached after a desired time at the input of the unijunction transistor PUT. Due to a reference voltage from a resistor-ladder which is given to the emitter pin of PUT power is connected through PUT to the cathode control pin of a thyristor-triode TIC. Then the TIC lets supply voltage pass through to an electrical bridge fuze initiator charge/explosive charge 24. The lower timer circuit branch in FIG. 3 (and all other branches if there are some more) operate in the same matter. By variation of $R_T$-values in the different branches a time delay from one branch to the other could be derived.

All mentioned charges are used as gas generators in order to blow up the balloons or to drive the fixing nails 38.1 and 38.2. If the illustrated charge 24 in a desired branch is replaced by a switching relay it is possible to control the switching valves 29 to let the balloons collapse.

Obviously, numerous and additional modifications and variations of the present invention are possible in light of the above teachings. It is therefore to be understood that within the scope of the appended claims, the invention may be practiced otherwise than as specifically claimed.

What is claimed is:

1. An arrangement for positioning a mine, comprising:

a mine housing having a bottom and a lateral exterior side;

an inflatable, balloon mounted on the lateral exterior side of said mine housing;

gas generating means disposed in said mine housing and connected to said balloon for providing a supply of gas for inflating said balloon;

position sensing means disposed in said mine housing for monitoring the upright position of the mine housing and connected to said gas generating means for controlling the supply of gas to said balloon in dependence of the upright position of said mine housing; and a plurality of fixing nails mounted in the bottom of said mine housing for fixing the position of said mine housing on the ground.

2. An arrangement as defined in claim 1, wherein said position sensing means comprises a verticality sensor.

3. An arrangement as defined in claim 1, wherein the mine is dropped into a target area by a carrier system, and said arrangement further comprises timing means disposed in said mine housing and connected to said position sensing means for causing said position sensing means to actuate said gas generating means for inflating said balloon after a settable period of time extending from the moment of landing of the mine on the ground until after the mine is completely at rest.

4. An arrangement as defined in claim 3, wherein said mine housing has a top side and said arrangement further comprises a head balloon attached to said top side and time delay means disposed in said mine housing for causing said gas generator means to fill said head balloon before filling said balloon mounted on the lateral exterior side of said mine housing.

5. An arrangement as defined in claim 1, wherein each fixing nail is comprised of a plurality of individually extendable nail members.

6. An arrangement as defined in claim 5, wherein each individually extendable nail member of each respective fixing nail includes an associated separate pyrotechnic charge which is separately actuatable for extending the individually extendable nail member.

7. An arrangement as defined in claim 5, wherein each individually extendable nail member of each respective fixing nail includes an associated arresting means for preventing the individually extendable nail member from sliding back once it has been extended.

8. An arrangement as defined in claim 5, and further comprising extending means for extending the fixing nails from the bottom of the mine housing; wherein said position sensing means includes means for interrupting the supply of gas to said balloon and is connected to said extending means for causing said fixing nails to be extended from the bottom of said mine housing after said housing reaches a presentable angle ($\alpha$) relative to the vertical.

* * * * *